United States Patent [19]

Borello

[11] Patent Number: 4,893,885

[45] Date of Patent: Jan. 16, 1990

[54] MODULAR KITCHEN UNIT

[75] Inventor: Marco Borello, Genova, Italy

[73] Assignee: Salvarani Industrie S.p.A., Parma, Italy

[21] Appl. No.: 284,636

[22] Filed: Dec. 15, 1988

[30] Foreign Application Priority Data

Mar. 3, 1988 [IT] Italy ..... 52939/88[U]

[51] Int. Cl.[4] ..... A47B 91/00

[52] U.S. Cl. ..... 312/250; 312/266; 312/277; 312/289

[58] Field of Search ..... 211/70.6; 312/250, 287, 312/285, 289, 277, 266

[56] References Cited

U.S. PATENT DOCUMENTS

| | | | |
|---|---|---|---|
| 895,640 | 8/1908 | Hullhorst | 312/285 X |
| 3,092,428 | 6/1963 | Kerschner | 312/289 X |
| 3,857,623 | 12/1974 | Schneller | 312/266 |
| 4,026,616 | 5/1977 | Kuehl | 312/250 |
| 4,511,040 | 4/1985 | Tolentino | 211/70.6 X |
| 4,659,154 | 4/1987 | Jenkins | 312/277 |
| 4,669,790 | 6/1987 | Briggs | 312/256 X |

*Primary Examiner*—Joseph Falk

*Attorney, Agent, or Firm*—Sughrue, Mion, Zinn, Macpeak & Seas

[57] ABSTRACT

A movable unit for a modular kitchen assembly is provided with wheels and is removable from a space provided below a countertop forming part of the modular kitchen assembly and includes a top which can be used, for example, as a chopping board or a meat-pounding board and is slidable on guides between a normal operative position and a position in which it projects from the unit and affords access to an upper compartment. The unit also has a front wall which is intended to match the modular kitchen assembly when the unit is fitted into the space below the countertop, a rear wall with a compartment provided with a shelf, and two side walls. One side wall has a compartment provided with a knife-rack, while an auxiliary shelf connected to the unit by a system of levers is movable between a lowered position within the unit and a raised position in which it projects from the unit through an opening provided in the other side wall.

2 Claims, 2 Drawing Sheets

MODULAR KITCHEN UNIT

BACKGROUND OF THE INVENTION

The present invention relates to a modular kitchen unit which is movable on wheels and is removable from a space provided below a countertop in a modular kitchen.

SUMMARY OF THE INVENTION

The unit according to the invention is characterised in that it comprises: a top which can be used, for example, as a chopping board or a meat-pounding board and is slidable on guides between a normal operative position and a position in which it projects from the unit and affords access to an upper compartment for holding articles, a front wall which is intended to match the modular kitchen assembly, a rear wall with a compartment provided with shelves, a side wall with a compartment provided with a knife-rack, and an auxiliary shelf connected to the unit by means of a lever transmission and movable between a lowered position in which it is contained within the unit and a raised position in which the auxiliary shelf projects from the unit through an opening provided in the opposite side to the said side wall.

The upper compartment which can be reached by the sliding of the top may be used for holding auxiliary electric household appliances, such as, for example, a foldable slicer, or for holding the requisites for laying or clearing the table (tablecloth, cutlery, table vacuum cleaner, etc.).

The additional compartment may be used for supporting an electric household appliance, for example a food processor, or other accessories. When the auxiliary shelf is brought into its raised position, the processor is easily accessible and, amongst other things, is in a position near the top of the unit, which can serve for supporting plates or various items being used by the processor. The compartment provided in the rear wall can be used for holding small objects, such as jars or the like, whilst the compartment provided in the side wall is used as a knife-holder.

The unit can therefore be used for increasing the useful working area of the kitchen, as an auxiliary unit for the laying and clearing of the table, or as a auxiliary unit for eating out of doors with a slicer, barbeques, and as required for the preparation of food for the plate.

BRIEF DESCRIPTION OF THE DRAWINGS

Further characteristics and advantages of the present invention will become clear from the description which follows with reference to the appended drawings, provided by way of non-limiting example, in which.

DETAILED DESCRIPTION OF THE INVENTION

Figure 1:
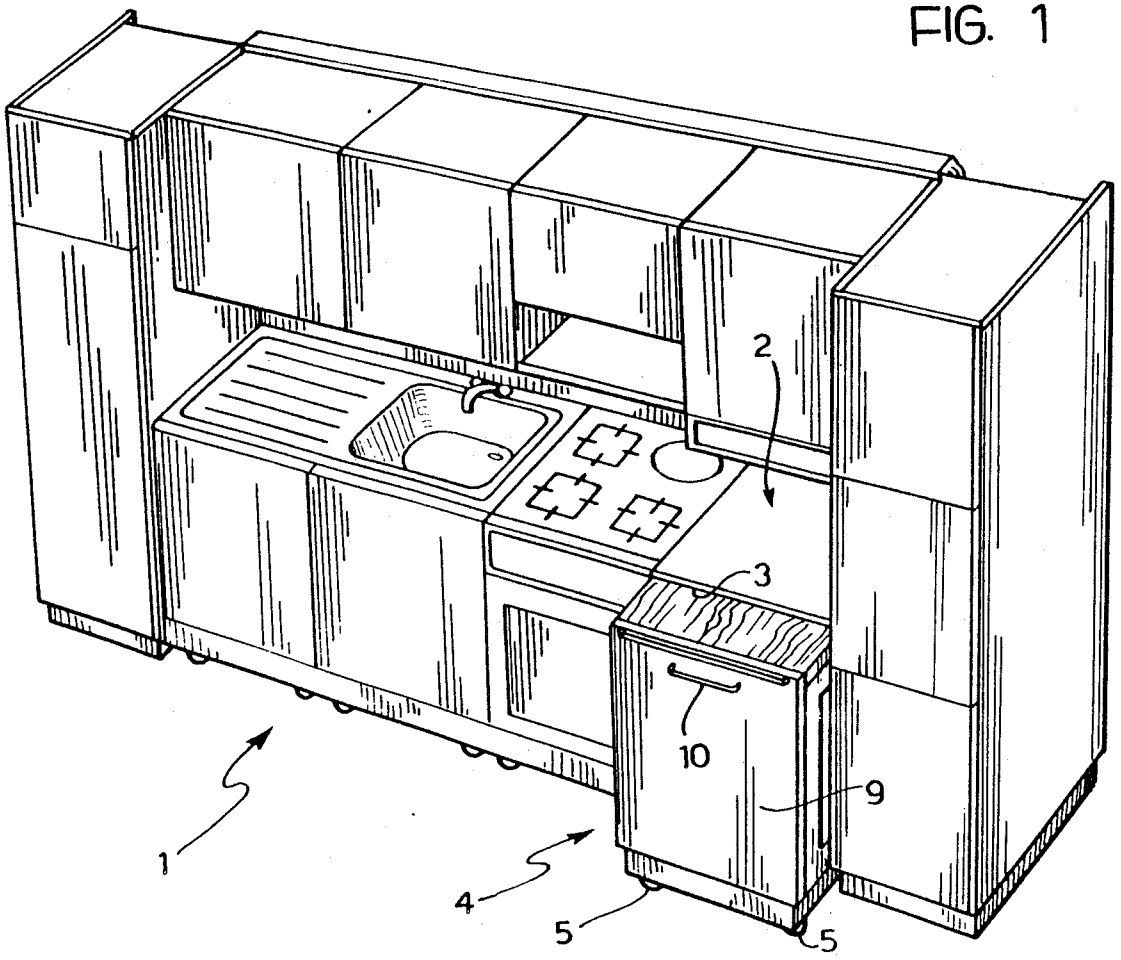
FIG. 1 is a perspective view of a kitchen fitment including the kitchen unit according to the invention.

In FIG. 1 a modular kitchen assembly is generally indicated 1 and includes, amongst other things, a countertop 2 with a space 3 therebelow. A movable unit 4 is fitted into the space 3 and is provided at the bottom with wheels 5 which make it transportable and removable from the space 3.

Figure 3:
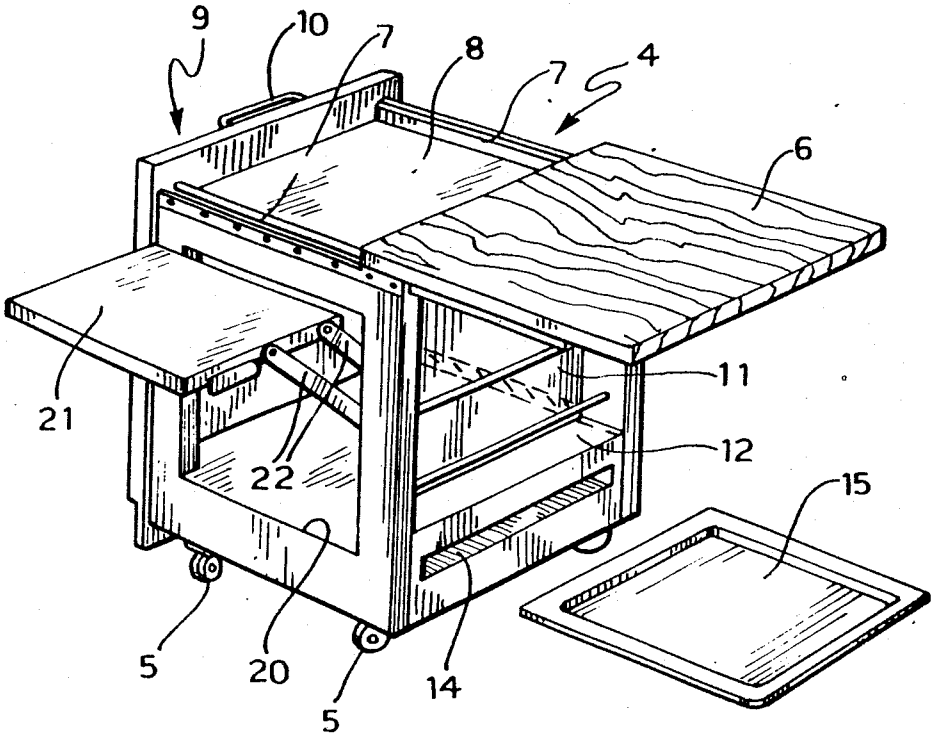
FIG. 3 is a perspective view of the unit of FIG. 2 in an operative condition.
Figure 2:
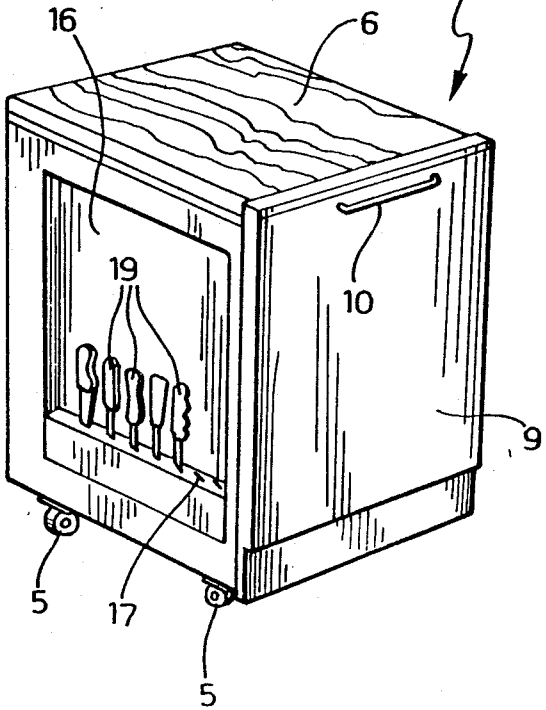
FIG. 2 is a perspective view of the unit according to the invention, on an enlarged scale.

With reference to FIGS. 2 and 3, the unit 4 has a top 6 which is mounted for sliding on guides 7 fixed to the upper edges of the two side walls of the unit 4. The top 6 is usable, for example, as a chopping board or a meat-pounding board and is movable between a normal operative position (FIG. 2) and a position in which it projects from the unit 4 (FIG. 3) and affords access to an upper compartment 8 which can be used, for example, for storing an auxiliary electric household appliance, such as a foldable electric slicer, or articles required for the laying or clearing of the table (tablecloths, cutlery, table vacuum cleaners, etc.). The front wall of the unit 4 is indicated 9 and is provided with a handle 10. This wall is preferably made so as to match the rest of the units of the modular kitchen 1 when the unit 4 is inserted in its space 3.

The unit 4 also includes a rear wall 11 with a shelf 12 and rods 13 for retaining small objects, for example, small jars, bottles or the like. The rear wall 11 also has a compartment 14 from which a tray 15 can be removed. A side wall of the unit is indicated 16 and has a rack 17 with slots 18 usable for holding knives 19. On the opposite side, the unit has an opening 20 from which can be pulled an auxiliary shelf 21 connected to the structure of the unit by a system of levers 22 forming an articulated parallelogram. The auxiliary shelf 21 is movable between a lowered position in which it is contained within the unit and a raised position (FIG. 3) in which it is arranged outside the unit, adjacent its top. An auxiliary electric household appliance, such as, for example, a food processor, may be placed on the shelf 21.

Naturally, the principle of the invention remaining the same, the details of construction may be varied widely with respect to those described and illustrated.

What is claimed is:

1. A movable unit for a modular kitchen, said unit having wheels and being adapted to be removably located in a space provided below a countertop forming part of said modular kitchen, said unit comprising:

housing means having front, rear, two side and bottom walls defining compartment means therein, said front wall being adapted to match said modular kitchen when said unit is fitted into said space;

said compartment means comprising an upper compartment, a guide means provided on an upper surface of said housing and a slidable cutting board movably mounted on said guide means to provide access to said upper compartment;

said rear wall having a recess therein defining a lower shelf for supporting a plurality of containers and retaining means associated with said recess for holding said containers on said lower shelf;

one of said side walls having a recess therein defining a lower shelf, said lower shelf having a plurality of slot means formed therein for vertically supporting cutlery in said recess;

said compartment means including a main compartment, the other of said side walls having an opening providing access to said main compartment; and auxiliary shelf means movably supported on lever means in said housing for movement between a position within said housing and a raised position in which said auxiliary shelf projects from the unit through said opening.

2. A movable unit as set forth in claim 1, wherein said compartment means include a tray compartment below said main compartment with said rear wall having an aperture therein providing access to said tray compartment.

* * * * *